United States Patent [19]

Poturalski

[11] 3,998,464

[45] Dec. 21, 1976

[54] THREE PLAYER CHESS GAME BOARD

[76] Inventor: Daniel H. Poturalski, 6694 S. Franklin St., Littleton, Colo. 80122

[22] Filed: May 16, 1975

[21] Appl. No.: 578,280

[52] U.S. Cl. ..... 273/131 KN; 273/131 AB; 273/131 B; 273/134 AG

[51] Int. Cl.[2] ..... A64F 3/02

[58] Field of Search ..... 273/131

[56] References Cited

UNITED STATES PATENTS

| | | | |
|---|---|---|---|
| 598,969 | 2/1898 | Anderton | 273/131 KN |
| 3,533,627 | 10/1970 | Deffenbaugh et al. | 273/131 AB X |
| 3,840,237 | 10/1974 | Shkolnik | 273/131 AB |

*Primary Examiner*—Delbert B. Lowe

*Attorney, Agent, or Firm*—Warren H. Kintzinger

[57] ABSTRACT

A game board for use with three sets of chess pieces whereby three players may simultaneously compete, each against the others. The board is in the shape of an equilateral triangle within which are three play areas each containing 36 rhomboid-shaped play spaces. At the center of the board is a space as an equilateral triangle connecting the three play areas. Between pairs of play areas is an area of elongated paths linking adjacent play spaces of each pair of play areas. A parallelogram-shaped area in each corner of the board provides a buffer between players.

7 Claims, 2 Drawing Figures

Figure 1:
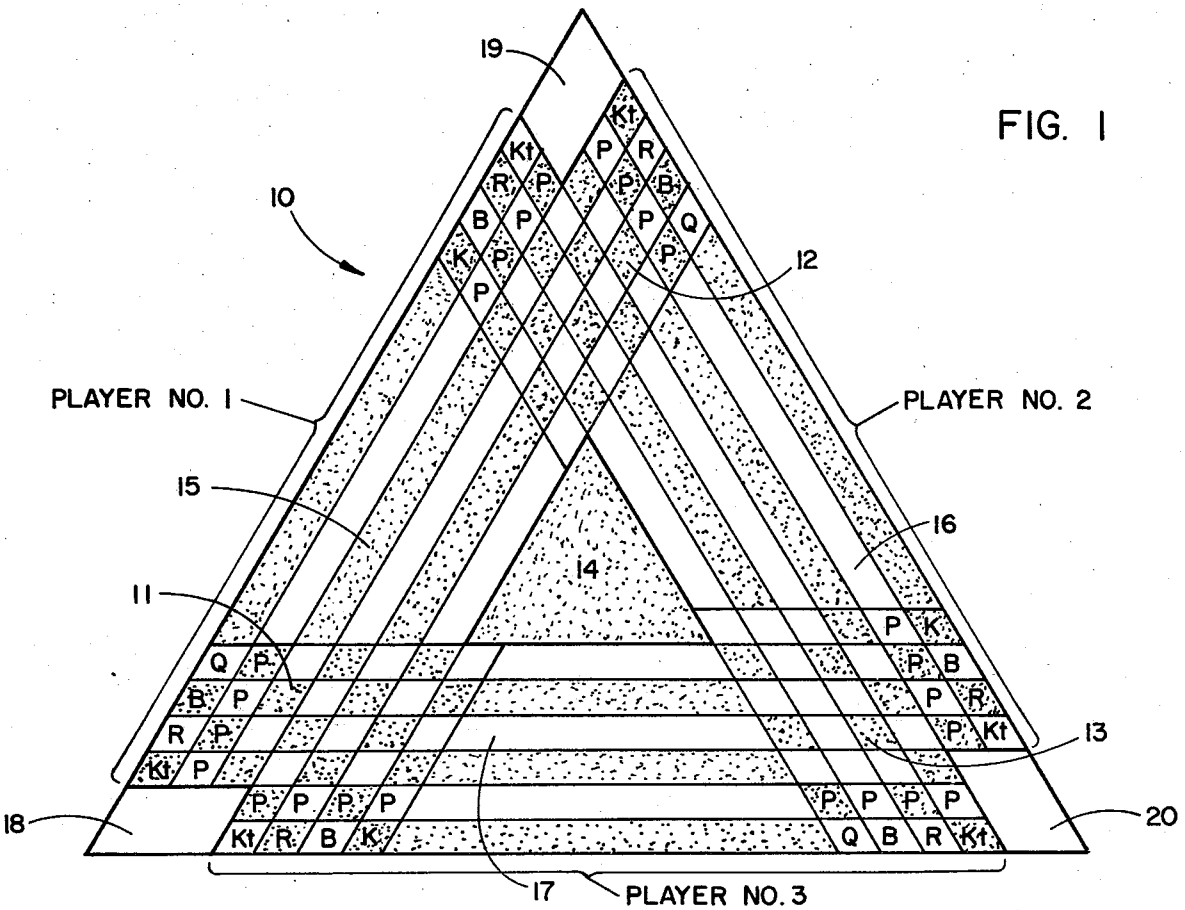

● POINT OF INITIATION OF MOVE
o VALID TERMINATION OF MOVE
x INVALID TERMINATION OF MOVE
PLAYER NO. 1
PLAYER NO. 2
PLAYER NO. 3
10
11
12
13
14
15
16
17
18
19
20
21
22
23
24
25
26
27
28
29
30
31
31a
31b
32
32a
33
33a
34
35
36
37
38
P
Q
B
Kt

THREE PLAYER CHESS GAME BOARD

This invention relates in general to board games and, in particular, to a board game utilizing standard chess pieces and allowing the simultaneous competitive play of three persons.

Although dating back to antiquity, the game of chess has remained basically the same throughout its history. It is traditionally a game played by two persons on a square board comprising 64 square spaces, 32 spaces being of a first color and 32 spaces being of a second color, the spaces of the first color alternating with the spaces of the second color. Many times, three persons who enjoy playing chess are together and, using the traditional chess board, only two of them can actively compete; the third must merely observe and/or kibbitz.

It is therefore a principal object of this invention to provide a chess game board enabling the simultaneous competitive play of three persons.

Another object is to provide a chess game which may be played with three conventional chess armies, by three persons.

A further object is to provide a three-person, chess-style game wherein movement of the pieces is identical or very similar to their respective movement in the traditional two-person game of chess.

Features of the invention useful in accomplishing the above objects include a generally triangular game board, comprising 108 rhomboidal play spaces, separated into three play areas. The play areas are connected at the center of the board by an equilateral, triangle-shaped space, and along the borders of the board by elongated paths.

A specific embodiment representing what is presently regarded as the best mode of carrying out this invention is illustrated in the accompanying drawings.

Figure 2:
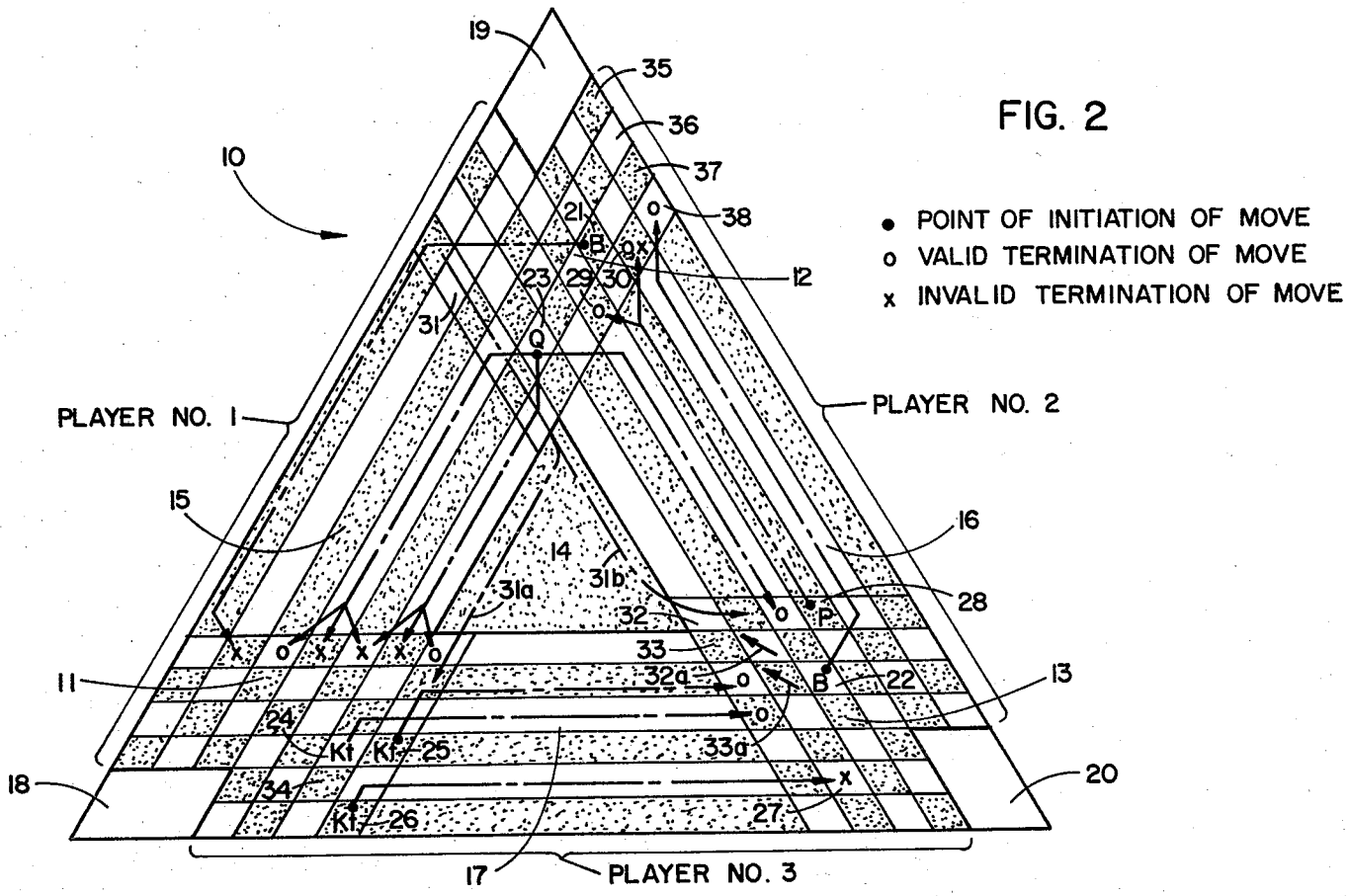

In the drawings:

FIG. 1 represents a plan view of a chess game board embodying the principles of this invention; and FIG. 2, a plan view similar to FIG. 1, showing allowable paths of movement for the various chess pieces.

Referring to the drawings:

FIG. 1 illustrates a three-player chess game board 10 constructed in accordance with the principles of this invention. Board 10 is in the shape of an equilateral triangle. Within this triangle, there are three play areas, 11, 12, and 13. Each of the play areas comprises 36 rhomboid-shaped play spaces colored in a checkered pattern. At the center of the board is a space 14 in the shape of an equilateral triangle. Between the sides of space 14 and the outer borders of board 10 are three areas, 15, 16, and 17, of elongated, trapezoidal-shaped path spaces linking adjacent play spaces of respective pairs of play areas. The play spaces are arranged in a six-space by seven-space matrix with parallelogram-shaped areas 18, 19, and 20 occupying a two-space by three-space area in each corner of board 10, to provide a buffer area between players. It should be noted at this point that since areas 18, 19, and 20 are merely for buffer purposes, they may be truncated to reduce the size of board 10. Similarly, center area 14 may be made smaller and the elongated paths in areas 15, 16, and 17 may be shortened to conserve space. These changes are not considered to be departures from the spirit and scope of this invention.

Each player controls a conventional chess army, each of a different color or configuration to distinguish it from the others. At the start of a game, the pieces of the armies are arrayed as shown in FIG. 1. It should be noted that the relative placement of the pieces as shown in FIG. 1 differs from their placement in the conventional chess game in that the positions of the Rooks (R) and Knights (Kt) are interchanged, as are the positions of the King (K) and the Queen (Q).

In the game, according to this invention, the Pawn is the only piece having rules of movement different from the rules in the conventional game of chess. It moves forward diagonally to the right or left and captures an opponent vertically, opposite from its movement in the conventional game of chess. An additional difference is that the Pawn is allowed to move only one space per turn, there being no option to move either one or two spaces on the first move. The remainder of the pieces move according to the rules of conventional two-man chess, with minor exceptions, due to the design of board 10, as will be described hereinafter.

The purpose of the path areas 15, 16, and 17, is to provide links between adjacent play areas 11 and 12, 12 and 13, and 11 and 13, respectively, allowing pieces to enter and leave the play areas through a controlled pattern. This controlled pattern maintains continuity in the movement patterns of the pieces. The individual path spaces are projections of the row of rhomboids along the right edge of the play areas. A piece movement resulting in passage along a path space may be initiated from any valid playing position in one of the play areas 11, 12, or 13. The point of termination of that movement is restricted to the row of play spaces immediately adjacent the end of the path space opposite the play area in which the movement was initiated. At the conclusion of a move, there can be no pieces remaining on a path space. The basic rule to be followed is that the direction of movement upon entry into a path space must be maintained at the point of entry into the next play area. This rule applies to diagonal as well as to straight moves. Additionally, if the termination point of the desired move is occupied by any other piece, the move cannot be made.

FIG. 2 illustrates permitted and prohibited moves utilizing the path areas 15, 16, and 17. In FIG. 2, a filled-in circle represents the initiation point of an illustrated move, an open circle, a valid termination of an illustrated move, and an X, an invalid termination of an illustrated move. The move shown for the Bishop (B) beginning in space 21 is invalid because the direction of the move is discontinuous upon entry into play area 11, whereas the move shown for the Bishop (B) beginning in space 22 maintains its direction and is valid. For the Queen (Q) on space 23, the moves shown as invalid are that way due to discontinuities in their directions of movement. The illustrated movements of the Knights (Kt) on spaces 24 and 25 are valid, but that of the Knight on space 26 is invalid because it terminates on a space 27 that is not in the row adjacent to the end of the path area 17. The movement of the Pawn (P) from space 28 to space 29 is valid, but the validity of its movement to space 30 is dependent upon the origin of the Pawn. Since a Pawn can move only forward, the move to space 30 is valid if the Pawn belongs to Player No. 3, but is invalid if it belongs to Player No. 2.

Moves traversing the center space 14 are subject to certain restrictions. Straight moves through space 14 may emanate only along path 31, or along corresponding paths in corresponding rows in the other play areas. These moves may then continue in a corresponding row in one of the other play areas, taking either path 31*a* or 31*b*, whichever is desired. Diagonal moves may enter space 14 from either spaces 32 or 33, or corresponding spaces in the other play areas, along the paths shown by arrows 32*a* and 33*a*, respectively. These moves then traverse space 14 and continue along respective corresponding paths in the desired other play area.

The rules of castling apply to the game according to this invention as they do to the traditional game of chess. The Bishop and Knight must be removed from their starting spaces. The restrictions regarding the use of the path areas do not apply to castling. The positions after castling are as follows: When castling to the left, the Rook occupies the former Bishop position and the King occupies the former Rook position. When castling to the right, the Rook occupies the former Queen position and the King occupies the former Bishop position.

As in the traditional game of chess, Pawns may be exchanged for power pieces. They must move from their home position to the furthermost row opposite their home position in order for the exchange to take place. For example, the Pawn having as its home position space 34 must move to one of spaces 35, 36, 37, or 38, for an exchange.

On the basis of the foregoing description, it is readily apparent that the play of the game according to this invention may be effected with a minimum of modification of the rules of the traditional game of chess. The players make their moves, sequentially, in a clockwise direction around the board. Play continues until two players are eliminated, the remaining player being the victor. When a player is defeated, either by checkmate or stalemate, his remaining army is removed from the board. Upon prior agreement of the players, in the event of a defeat by checkmate of the first eliminated player, the remaining two players can use that portion of the eliminated player's forces that they had captured up until the checkmate move to count as point values in determining a winner in case a stalemate situation results from the battle between the remaining two players.

One feature of the game according to this invention, that differs from the traditional game of chess is the ability of the players to form alliances. Two players may ally to defeat the third player and then battle between themselves to determine the final victor. However, the players may agree prior to the start of the game that aliances will not be allowed. In such event, a player may invoke certain penalties, as set forth hereinafter, if he can prove that an infraction of the non-alliance pact has occurred. A feature of the non-alliance pact is that two forces cannot advance toward the same specific objective. If it can be shown that there had been two direct moves on the part of each of two players within the last six (or fewer) moves, the third player can call for a penalty for violation of the non-alliance pact. The third player has a choice of two penalties that he can call for. He can call for either a stalemate, that would result in his forces being discontinued from the game, or alternatively, he can call for a retraction of the move which caused the pact violation, regain any piece that was lost due to that move, and gain the right to make a move immediately after the retraction. The game then continues. If the move that led to the violation is repeated, the penalty can again be invoked. Another violation of the non-alliance pact comes about from the consistent wearing down of one player's forces by the direct advances of the other two players, without reasonable interference of the latter's forces between each other. Statistically, aggressive moves by one player against the others should be evenly divided. If over 55 percent of the moves of both of two players are advances against the third, and the third player suffers losses, having point values exceeding by a ratio of 2 to 1, the point values of the losses of either opponent, then the third player can cite a violation of the non-alliance pact. For such a violation, the penalty is a total stalemate of the game and play is discontinued.

While this invention is herein illustrated and described with respect to a single embodiment thereof, it should be realized that various changes may be made without departing from the essential contributions to the art made by the teachings hereof.

I claim:

1. A game apparatus having the peripheral configuration shown in FIG. 1 of the drawing and having on its surface the game pattern shown in said FIG. 1; together with three visually distinguishable sets of chess pieces for playing the game.

2. A game apparatus for the play of a chess-like game by three players comprising: a generally equilateral, triangularly-shaped board member having its surface divided into three play areas at the corners of said board member, three path areas connecting pairs of said play areas, and a center area; each of said play areas including 36 rhomboid-shaped play spaces colored in a checkered pattern, said play spaces comprising those defined by a six space - by seven space matrix exclusive of a two space - by - three space parallelogram-shaped area in the respective corner of said board member; together with three visually distinguishable sets of chess pieces for playing the game.

3. The game apparatus of claim 2, wherein each of said path areas comprises six trapezoidal-shaped path spaces, each of said path spaces connecting a pair of play spaces.

4. The game apparatus of claim 2, wherein said center area is in the shape of an equilateral triangle.

5. The game apparatus of claim 1, with each said sets of chess pieces including eight pawns, two rooks, two knights, two bishops, a queen and a king.

6. The game apparatus of claim 2, with each of said sets of chess pieces including eight pawns, two rooks, two knights, two bishops, a queen and a king.

7. The game apparatus of claim 4, with each of said sets of chess pieces including eight pawns, two rooks, two knights, two bishops, a queen and a king.

* * * * *